US006316740B1

(12) United States Patent
Merkin et al.

(10) Patent No.: US 6,316,740 B1
(45) Date of Patent: Nov. 13, 2001

(54) PROTECTED CONFIGURATION SWITCH

(75) Inventors: Cynthia M. Merkin, Georgetown; James D. Curlee, Round Rock, both of TX (US)

(73) Assignee: Dell USA, LP, Round Rock, TX (US)

( * ) Notice: Subject to any disclaimer, the term of this patent is extended or adjusted under 35 U.S.C. 154(b) by 0 days.

(21) Appl. No.: 09/491,289

(22) Filed: Jan. 25, 2000

(51) Int. Cl.[7] ..... H01H 1/00
(52) U.S. Cl. ..... 200/502; 200/43.11
(58) Field of Search ..... 200/43.11, 43.16, 200/43.22

(56) References Cited

FOREIGN PATENT DOCUMENTS

176066 * 4/1986 (EP) .

* cited by examiner

*Primary Examiner*—Paula Bradley
*Assistant Examiner*—Nhung Nguyen
(74) *Attorney, Agent, or Firm*—Skjerven Morrill MacPherson LLP; John A. Odozynski

(57) ABSTRACT

A configuration switch assembly for a computer system includes a protected switch for selectively enabling or disabling a function of the computer system, as determined by the state of the switch. The switch is mounted on the interior surface of a chassis panel. In one embodiment, a slide lock is installed in a guide on the exterior surface of the chassis panel. The slide lock alternatively engages, or disengages from, the switch as it travels between two limit positions that are determined by an aperture in the guide and a cam extending from the slide lock. The slide lock is lockable in one of the two positions so that when the slide lock is locked, the state of the protected switch cannot be altered, and the function, as established by the locked state of the switch, is protected.

55 Claims, 3 Drawing Sheets

PROTECTED CONFIGURATION SWITCH

BACKGROUND OF THE INVENTION

1. Field of the Invention

This invention relates to the design and operation of electronic equipment, including computer systems, and, more particularly, to a mechanism for selectively determining a mode of operation of such equipment, wherein the mechanism may be rendered substantially inaccessible to unauthorized intrusion.

2. Description of the Related Art

It is frequently desirable in the design and operation of electronic equipment, including, for example, computer systems, that various functions of the equipment be rendered individually enabled or configurable by the user. With specific reference to computer systems, configuration information had been formerly provided to the system processor by the computer user's selection of the state of a bank of DIP mechanical switches that were physically installed on the computer motherboard. More recently, configuration information is stored in a CMOS RAM, and the processor reads the configuration data during the initialization process. In addition to configuration data, it is often desirable that certain other aspects or features of the computer system operation be selectable by the user. Often the user is simply presented with an option either to enable or disable a function, or to select between two or more available modes of operation.

An example of computer functionality that might require or accept user's assertion to enable or disable the function is the publication of the computer system serial number. This represents a relatively new feature in personal computer systems, and concern has been expressed with respect to the privacy implications attendant publication of system serial numbers. In order to mitigate this concern, it has been proposed that the function be selectively disabled, under user control, through the operation of installed software. However, in response to anticipated suspicions that the software may not uniformly operate as endorsed, a more tangible mode, such as a jumper wire on the motherboard, has been considered as an alternative means for selectively enabling or disabling the function. Of course, connection of the jumper wire requires opening the computer cabinet, setting the jumper, and then closing the cabinet. Because there may be some circumstances where the serial number must be conveyed, for example, in order to gain access to certain protected resources, such as some sites on the worldwide web, jumper wire connection and disconnection promises to become a recurrent process, and a recurrent nuisance. An externally accessible switch would seem to be preferable, to the extent that the inconvenience of opening and closing the computer cabinet may be circumvented.

As another example, the advent of e-commerce transactions has given rise to the requirement that PCs have the capability to store and deliver digital certificates, security tokens, and other similar information. Because of the threat that such information may be hacked into and the user's security compromised, it appears judicious to have this functionality normally disabled, but conveniently enabled when the computer user desires to engage in e-commerce or other secured or verified transactions. Conversely, in the business environment, an IT administrator might desire to have the function "almost always ON" in an employee's computer. In this situation, the end-user employee would be denied the capability of countervailing the setting established by the IT administrator.

Accordingly, what is desired is a technique for selectively enabling or disabling a function to electronic equipment, such as computer systems. The technique should be convenient to use, yet provide security from unauthorized, or otherwise unwarranted, intrusion.

SUMMARY OF THE INVENTION

The above and other objects, advantages and capabilities are achieved in one aspect of the invention by a configuration switch assembly that determines at least one aspect of the operation of electronic equipment, such as a computer system. The switch assembly comprises, or is incorporated into, an enclosure for the equipment. The enclosure includes a panel having an exterior surface and an interior surface. A protected switch is disposed within the enclosure for coupling to the electronic equipment so that at least an aspect of the operation of the electronic is determined by the state of the protected switch. A lock associated with the switch is accessible outside the enclosure and operates to selectively prevent access to the protected switch. In this manner, the aspect of the operation of the electronic equipment that is determined by the protected switch may be rendered immune to unauthorized intrusion by locking the protected switch.

In an exemplary manifestation of the invention, the exterior surface exhibits a guide and a lock recess disposed at one end of the guide, as well as an aperture cut through the guide. A slide lock is slidably positioned in the guide and has an arm extending outwardly in a direction away from the exterior surface of the panel. A cam extends from the slide lock, through the aperture, and beyond the interior surface. The slide lock also contains a lock recess that is dimensionally congruent to the guide lock recess. A protected switch is affixed to the interior surface of the panel, in proximity with the longitudinal aperture. The switch is adapted to be electrically coupled to functional components of the equipment, so that at least one operational characteristic of the equipment is determined by the state (open, closed) of the switch.

Another aspect of the invention is embodied in a configuration switch assembly for selectively enabling or disabling a function of a computer system. The assembly comprises an enclosure for the computer system and a protected switch adapted for coupling to a device within the computer system for selectively enabling or disabling a function of the computer system. A first lock is movably attached to the enclosure and is operable to engage the protected switch when placed in a first position and to disengage from the protected switch when placed in a second position. The assembly includes a second lock for locking the first lock in either the first position or the second position so that the switch is protected from unauthorized operation when the first lock is locked.

A further embodiment of the invention is realized in a computer system comprising a configuration switch assembly for selectively enabling or disabling a function of the computer system. The configuration switch assembly comprises an enclosure for the computer system and a protected switch adapted for coupling to a device within the computer system for selectively enabling or disabling a function of the computer system. A first lock is movably attached to the enclosure and operates to engage the protected switch when placed in a first position and to disengage from the protected switch when placed in a second position. A second lock is provided for locking the first lock in either the first position or the second position so that the switch is protected from unauthorized operation when the actuator is locked.

The invention may also be encountered in a method of facilitating computer system user's selective enabling or disabling of a function of a computer system. The method comprises the steps of affixing a protected switch to an interior surface of a computer system enclosure and providing a lock on an exterior surface of the enclosure. The lock is slidably disposed in a guide so that the slide lock is movable under user control between a first position and a second position. In the second position, the lock is engaged with the protected switch and is lockable.

From the user's perspective, the invention may be perceived as a method that facilitates the selective enabling or disabling of a function, or an aspect of the operation, of a computer system. Specifically, a protected switch that determines at least an aspect of the operation of the computer system is affixed to an interior surface of a computer system enclosure. A slide lock disposed on an exterior surface is moveable under user control between a first position, in which the slide lock is engaged with the protected switch, and a second position, in which the slide lock is disengaged from the protected switch. The user may lock the slide lock in at least one of the first and second positions so that the slide lock, when locked, renders the protected switch insusceptible to unauthorized intrusion.

BRIEF DESCRIPTION OF THE DRAWINGS

The subject invention may be understood, and its numerous objects, advantages and capabilities made apparent to those skilled in the art, with reference to the Drawings described below and attached hereto, in the several Figures of which like reference numerals indicate identical elements and where.

DETAILED DESCRIPTION

For a thorough understanding of the subject invention, reference is made to the following Description, including the appended Claims, in connection with the above described Drawings.

Figure 1A:
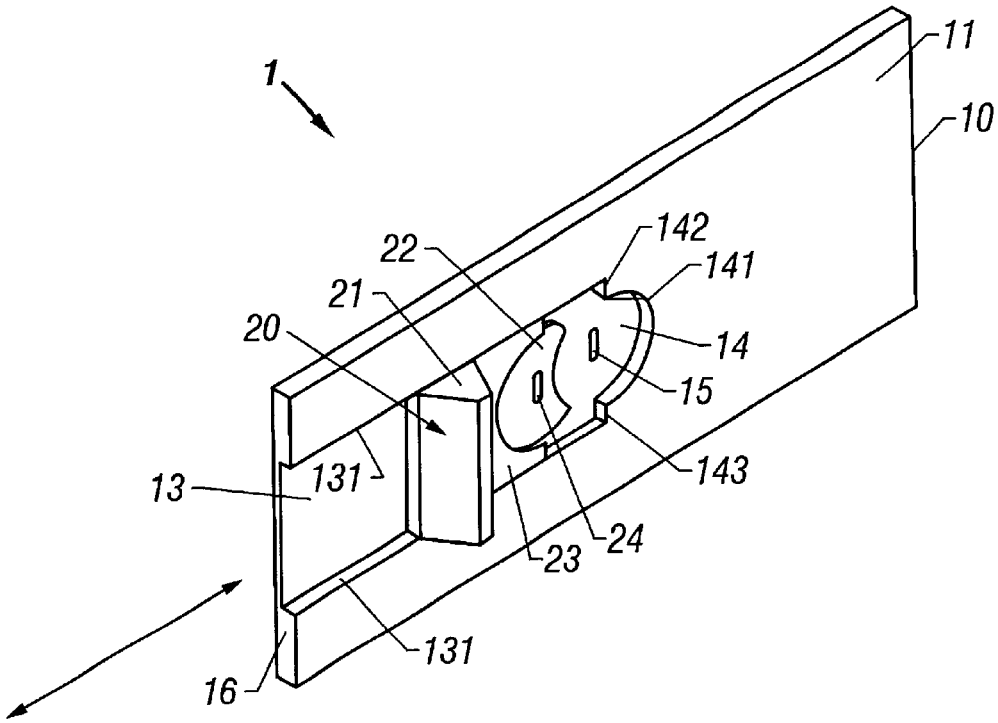
FIG. 1A is a perspective view, directed at the exterior surface of a computer system enclosure, of the subject invention, with the protected switch engaged and unlocked.
Figure 1B:
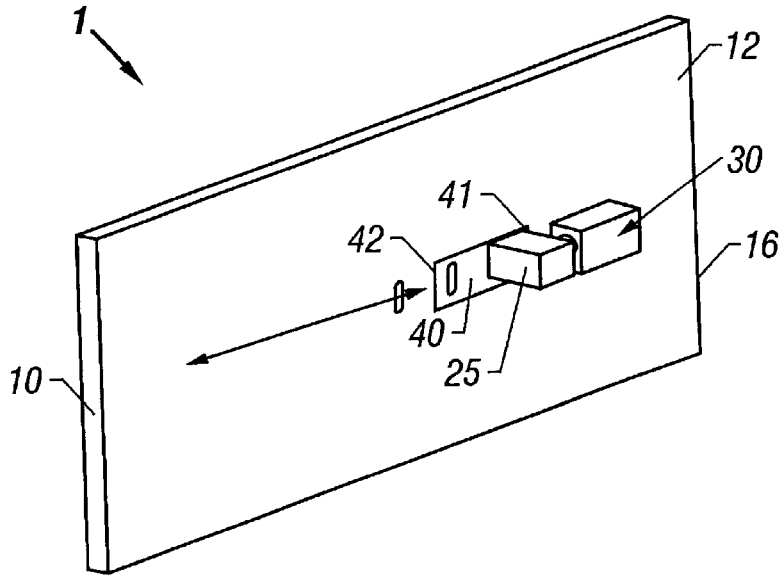
FIG. 1B is a perspective view, directed at the interior surface of a computer system enclosure, of the subject invention, with the protected switch engaged and unlocked.

Attention is first directed to the configuration switch assembly 1, as illustrated in FIGS. 1A and 1B. FIG. 1A is a perspective view directed at the exterior surface 11 of the rear panel, or bezel, 10 that constitutes a part of the enclosure typically used to confine a computer system, for example. FIG. 1B is a perspective view directed at the interior surface 12 of rear panel 10. (Neither the remaining portions of the computer system enclosure, nor the constituent electronic assemblies of the computer system, are requisite to the invention, or to comprehension thereof, and are consequently not illustrated in the Drawings.)

As may be seen in FIG. 1A, exterior surface 11 is substantially rectangular in outline, and exhibits an elongated, horizontally extending guide 13. Guide 13 extends from a first side 16 of the rear panel and terminates in a lock recess portion 14, disposed at about the center of the rear panel. With continued reference to FIG. 1A, the lock recess portion is seen to have a semicircular perimeter 141. Both guide 13 and lock recess 14 are cut into the bezel a predetermined depth from external surface 11. Recess 14 is substantially semicircular in outline, with a diameter slightly less than the height of guide 13, so that lock recess exhibits ledges 142 and 143 defined between the edges 131 of guide 13 and the semicircular perimeter of lock recess 14. A vertical slot 15 is cut in lock recess 14.

Figure 3A:
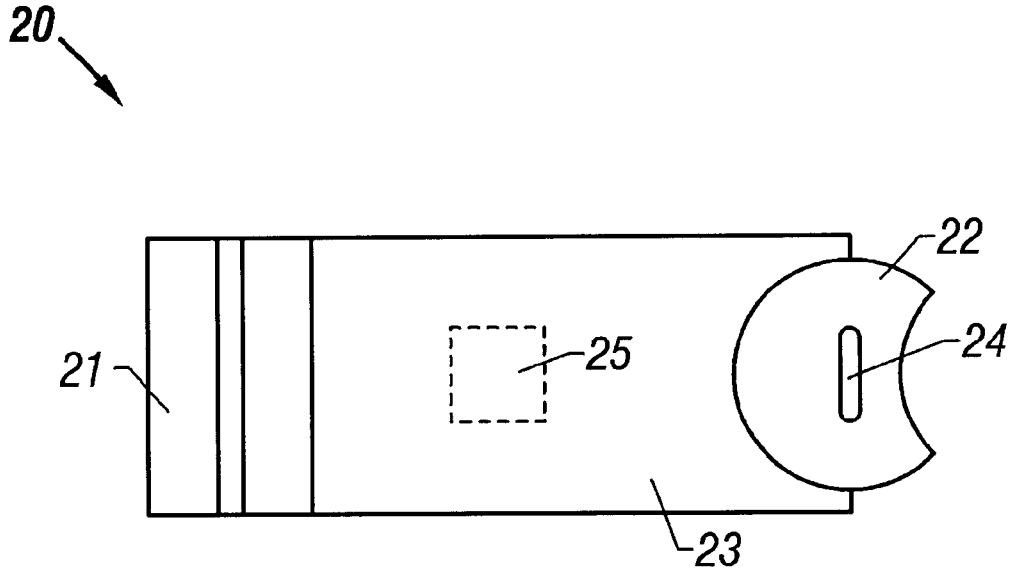
FIG. 3A is a front view of a slide lock for use in connection with the invention.
Figure 3B:
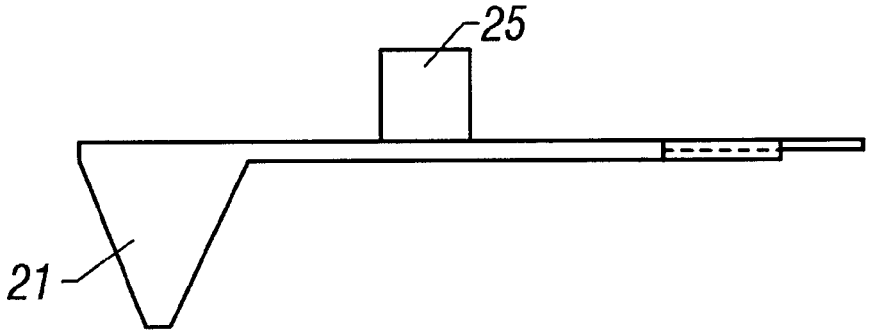
FIG. 3B is a top view of the slide lock depicted in FIG. 3A.

As may also be seen in FIG. 1A, as well as in FIGS. 3A and 3B, a slide lock 20, exhibiting an arm 21, a body portion 23, and a slide lock recess 22 is installed in the guide 13 of rear panel 10, so that the slide lock may be positioned between two positions along a horizontal path defined by guide 13. Arm 21 is seen to extend outwardly in a direction away from exterior surface 11. The lock recess 22 of slide lock 20 has a semicircular perimeter that may be defined by a diameter equal to the diameter of lock recess 14. In addition, slide lock 20 exhibits a vertical slot 24. In a manner more fully described below, when the slide lock is positioned to lock the protected switch 30, vertical slot 24 aligns with the vertical slot 15. Although the significance of the arrangement between the slide lock 20 and protected switch 30 will be made clear below, it is important to understand that use of a slide lock represents a preferred embodiment of the invention, to which certain advantages attach. However, the essence of the invention is not predicated on the slide lock per se, but embraces all techniques that achieve the objective of protecting switch 30, or its equivalent, from unauthorized intrusion.

Remaining features of the configuration switch assembly are more readily discerned from FIG. 1B. FIG. 1B reveals an elongated rectangular aperture 40 that is cut through panel 10 and extends (when viewing panel 10 at its interior surface 12) approximately from the center of the panel to a position somewhat rightward thereof. A switch 30, comprising a housing 31 and an actuator 32 (more conveniently viewed in FIG. 2B), is affixed to interior surface 12. In proximity to elongated aperture 40. FIG. 1B also reveals a cam element 25 that is integral to slide lock 20 and that extends through elongated aperture 40, beyond interior surface 12, into the interior of the computer system enclosure. As may be appreciated from FIG. 1B, interaction of cam 25 with the vertical walls 41 and 42 of aperture 40 defines the extent of travel permitted to slide lock 20. That is, slide lock 20 is constrained to travel a path along guide 13 between a rightmost position in the direction of panel edge 16, where cam 25 will abut edge 41 of aperture 40. In this posture, actuator 32 of switch 30 will be forced into housing 31, and the switch will be electrically CLOSED. Travel of the slide lock in a direction toward the center of the rear panel, that is in the direction of recess 14, is constrained, either by the abutment of edges 221 to edges 141, or by the abutment of cam 25 to side 42 of aperture 40. In the centermost position, cam 25 is disengaged from switch 30, and the switch is assumed to be electrically OPEN.

As to operation of the configuration switch assembly, retain attention to FIG. 1, which depicts, in both FIG. 1A (external view) and FIG. 1B (internal view) the slide lock 20 disposed in a first position, that is, in a position in which slide lock 20 is contiguous to and engaged with protected switch 30. The slide lock is caused to be engaged with switch 30, through cam 25, by the exertion of force (manual or otherwise) on arm 21, so that slide lock travels along guide 13 in the left direction in FIG. 1A, corresponding to rightward movement in FIG. 1B. With the slide lock thus engaged with protected switch 30 through cam 25, actuator 32 is depressed, and switch 30 is rendered in an electrically CLOSED state. Switch 25 is coupled, as by a coaxial cable or twisted pair (not shown), to functional components within the computer system. In the present embodiment of the invention, it is assumed that, with switch 30 in the CLOSED state, operation of those components is disabled.

Figure 2A:
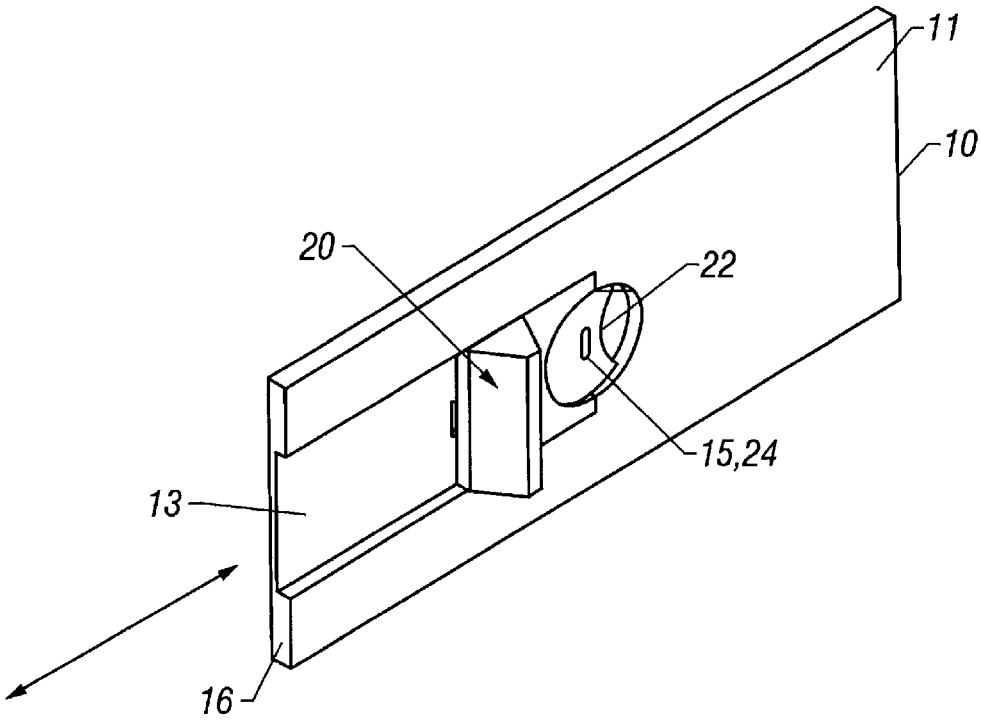
FIG. 2A is a perspective view, directed at the exterior surface of a computer system enclosure, of the subject invention, with the protected switch disengaged and disposed to be locked.
Figure 2B:
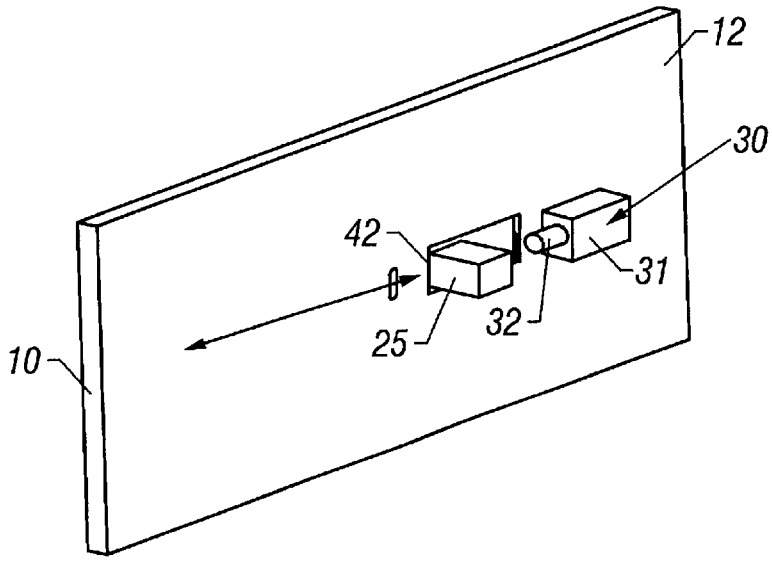
FIG. 2B is a perspective view, directed at the interior surface of a computer system enclosure, of the subject invention, with the protected switch disengaged and disposed to be locked.

Reference is now made to FIG. 2, including FIG. 2A and FIG. 2B. In FIG. 2, the application of force to slide lock arm 21 in a rightward direction (when viewed externally to the computer system enclosure) causes cam 25 to disengage from switch 30, and the protected switch consequently assumes OPEN state. With the switch OPEN, the implicated functional components of the computer system are enabled, the reverse of the situation that obtains in FIG. 1.

Referring now specifically to FIG. 2A, note that slide lock recess 22 is now positioned congruently with guide recess 14, and the mated perimeters of recess 22 and recess 14 form, in combination, a substantially circular perimeter. In addition, vertical slot 24 is aligned with vertical slot 15. This arrangement enables slide lock 20 to be locked into position by the use of any number of mechanical locking mechanisms. For example, FIG. 4 depicts the Master Lock® product, Model #64032, available from the Kensington Technology Group, a division of ACCO Brands, an operating company of Fortune Brands, Inc. (the "Kensington lock"). The Kensington lock has a body outline that conforms to lock recesses 14 and 22, and an armature that may be inserted through apertures 15 and 24. In order to lock slide lock 20, and equivalently, protected switch 30, the armature is simply inserted through the aperatures and locked into place with a removable key. In accordance with the specific embodiment of the invention presently described, locking slide lock 20, as shown in FIG. 2, is tantamount to locking the protected switch, in the OPEN state. With the protected switch locked OPEN, the associated computer system function in enabled, and will remain enabled until lock 20 is unlocked. In this manner the switch and, equivalently, the associated computer system function are rendered substantially immune to unauthorized unwarranted intrusion.

As a specific example of the utility of the subject invention, recall that publication of a personal computer system serial number may qualify as a function or feature that may be desired to be protected. When the slide lock is disposed as in FIG. 1, that feature may be assumed to be disabled. This result follows from the closure of switch 30, and the effect imparted by such closure to devices on the computer system motherboard that implement that function. Conversely, when the slide lock is disposed as in FIG. 2, switch 30 will be OPEN, and the feature (serial number publication) will be enabled. In addition, with the slide lock so disposed, it is possible for the user, or a system administrator (if the computer system is deployed in an enterprise environment), to permanently enable the function.

Although the subject invention has been described with respect to the specific exemplary embodiment disclosed in the Description above, the invention is not limited to a single embodiment. Various modifications, additions or improvements may be devised by those with skill in the art; and such modifications, additions, or improvements are to be comprehended as within, or deemed equivalent to, the scope of the invention as defined by the appended Claims. For example, in the context embodiment of the invention described herein, when the slide lock is positioned to engage the protected switch, the switch is caused to be CLOSED. With the protected switch in the CLOSED state, the associated computer system function is disabled.

Conversely, when the slide lock is positioned to be disengaged from the protected switch, the switch is OPEN, and the respective function is consequently enabled. In this position the slide lock is lockable with the Kensington lock, or some other lock mechanism. The above instantiation of the inventive concept represents only one of numerous possible combinations of binary values attributable to conditions that may define the state of the configuration switch assembly.

That is, the design and operation of the configuration switch assembly may be characterized by a set of four conditions, each of which may be associated with a respective variable $x_1$, $x_2$, $x_3$ and $x_4$. Specifically, the variable $x_1$ is defined to indicate whether the switch is engaged or NOT engaged. $x_1$ will be defined to have the value 1 when the switch is engaged, and the value 0 when the switch is not engaged. With respect to the embodiment described herein, the switch is engaged when cam 25 depresses actuator 32, and $x_1$ will then have a value=1. The variable $x_2$ defines the state of the protected switch, and has a value=1 when the switch is CLOSED and a value=0 when the switch is OPEN. The variable $x_3$ indicates whether the function determined by the protected switch is enabled or NOT enabled. When the function is enabled, $x_3=1$; when the function is NOT enabled, $x_3=0$. Finally, the variable $x_4$ indicates whether the switch is lockable or NOT lockable, with the respective values for $x_4$ being either 1 or 0.

With the above convention established, it may readily be seen that FIGS. 2A and 2B depict an embodiment of the invention wherein the conditions $\{x_1=1, x_2=1, x_3=0, x_4=0\}$, and $\{x_1=0, x_2=0, x_3=1, x_4=1\}$ are valid. That is, when switch 30 is engaged by cam 25, $x_1=1$ and $x_2=1$, that is, the switch is CLOSED. Consequently, the associated computer system function is disabled, $x_3=0$, and the switch is NOT lockable, $x_4=0$. Conversely, when switch 30 is not engaged by cam 25, the switch will be OPEN, and $x_1=x_2=0$. As a result, the associated computer system function will be enabled, $x_3=1$, and the switch is lockable, $x_4=1$.

A number of alternative embodiments of the invention are not specifically depicted but are routinely derived from the above Description. For example, the configuration switch assembly may be designed so that the condition $\{x_1=1, x_2=0, x_3=1, x_4=0\}$, representing a configuration where the protected switch is OPEN when engaged by the slide lock, and the computer function is then NOT lockable in the enabled mode, that is, the enabled mode is not protected. As an additional example of modifications that might readily occur, note that, the protected switch is described as electrically coupled to the computer system. In fact, other coupling mechanisms, such as optoelectronic or pure mechanical coupling, may be preferred in other applications. Further, although protected switch 30 has been described as embodied in eletromechanical form, it is apparent that other forms of switching elements are within the scope of the invention as claimed. The salient aspect of the invention inheres in the deployment of a locking mechanism, external to the equipment enclosure, that operates to selectively deny access to a (protected) switch that determines, establishes or affects some aspect of the operation of the equipment. The preferred embodiment of the locking mechanism contemplates a slide lock that is selectively engageable with the protected switch and that is, in turn, lockable in position through a second lock, such as the Kensington lock referred to above. This embodiment enables the protected switch to be controlled without access to the interior of the computer system and without requiring that the enclosure be opened. However, other, less evolved, embodiments that merely involve securing the protected switch with some rudimentary mechanical lock, or simply a cover, or locking and unlocking the enclosure, are similarly deemed within the scope of the invention.

What is claimed is:

1. A computer system comprising:

an enclosure for electronic equipment, the enclosure defining an interior area, and having an exterior surface and an interior surface;

a protected switch disposed within the enclosure, the protected switch for coupling to the electronic equipment so that at least an aspect of the operation of the electronic equipment is determined by the protected switch; and a locking mechanism accessible outside the enclosure and operable to selectively prevent access to the protected switch.

2. A computer system as defined in claim 1, wherein the locking mechanism comprises a first lock movably affixed to the enclosure so that when the first lock is locked in a first position, the protected switch is rendered insusceptible to unauthorized operation.

3. A computer system as defined in claim 2, wherein the first lock has an arm extending outwardly in a direction away from the exterior surface of the enclosure and a cam extending into the interior area.

4. A computer system as defined in claim 2, wherein the first lock is movable between a first position in which the cam is not engaged with the protected switch and a second position in which the cam is engaged with the protected switch.

5. A computer system comprising a configuration switch assembly for selectively enabling or disabling a function of the computer system, the configuration switch assembly comprising:

an enclosure for the computer system;

a protected switch for coupling to a device within the computer for selectively enabling or disabling a function of the computer system; and a slide lock movably attached to the enclosure and operable to engage the protected switch when placed in a first position and to disengage the protected switch when placed in a second position.

6. A computer system as defined in claim 5, wherein the slide lock is locked in the first position.

7. A computer system as defined in claim 6, wherein the computer system function is disabled.

8. A computer system as defined in claim 6, wherein the computer system function is enabled.

9. A computer system as defined in claim 6, wherein the slide lock is locked in the second position.

10. A computer system as defined in claim 9, wherein the computer system function is disabled.

11. A computer system as defined in claim 10, wherein the computer system function is enabled.

12. A method of facilitating a computer system user's selective enabling or disabling of a function of a computer system, the method comprising the steps:

affixing a protected switch to an interior surface of a computer system enclosure; and providing a slide lock on an exterior surface of the enclosure, the slide lock slidably disposed in a guide so that the slide lock is movable under user control between a first position and a second position, in which second position the slide lock is engaged with the protected switch and is lockable.

13. A method as defined in claim 12, wherein, in the second position, the slide lock is engaged with the protected switch through a cam that is integral to the slide lock and extends beyond the interior surface.

14. A method of selectively enabling a function of a computer system, the method comprising the steps:

positioning a slide lock that is accessible on an exterior portion of the computer system enclosure along a path of travel that is defined by a guide so that is incorporated into the enclosure that a cam integral to the slide lock engages a protected switch that is affixed to an interior surface of the computer system enclosure and that is coupled to a device that affects the function; and locking the slide lock so that the protected switch is not easily accessible to unauthorized access.

15. A computer system comprising:

an enclosure, the enclosure containing a guide for mounting a slide lock;

a protected switch attached on an interior portion of the enclosure for coupling to a device within the computer system for selectively enabling or disabling a function of the computer system; and a slide lock movably attached to the guide and operable to engage the switch when placed in a first position and to disengage from the switch when placed in a second position.

16. A computer system as defined in claim 15, wherein the guide is formed on an exterior portion of the enclosure.

17. A computer system as defined in claim 16, wherein the enclosure contains a lock recess disposed in proximity with an extremity of the guide.

18. A computer system as defined in claim 15, wherein the guide exhibits a horizontal aperture.

19. A computer system as defined in claim 18, wherein the slide lock comprises a body portion that is movably positioned within the guide so that the slide lock is movable along a portion of the length of the guide between a first position and a second position.

20. A computer system as defined in claim 19, wherein the slide lock comprises a cam that protrudes from the body of the slide lock in a direction toward the protected switch.

21. A computer system as defined in claim 20, wherein the cam protrudes through the horizontal aperture so that the slide lock is movable along the length of the guide through a distance that is determined by the length of the horizontal aperture.

22. A computer system, as defined in claim 21 wherein, when disposed in the second position, the slide lock causes the protected switch to be rendered in a second condition.

23. A computer system as defined in claim 22, wherein, when the slide lock is disposed in the second position, the cam is not contiguous to the protected switch.

24. A computer system as defined in claim 21, wherein, when disposed in the first position, the slide lock causes the protected switch to be rendered in a first condition.

25. A computer system as defined in claim 24, wherein, when the slide lock is disposed in the first position, the cam is contiguous to the protected switch.

26. A computer system as defined in claim 15, wherein the enclosure contains means for slidably mounting the slide lock so that the slide lock is operable to slide along a path between a first position and a second position.

27. A computer system as defined in claim 26, wherein the enclosure contains a lock recess.

28. A computer system as defined in claim 27, wherein the means for slidably mounting the slide lock is a guide.

29. A computer system as defined in claim 28, wherein the guide is disposed in an exterior portion of the enclosure.

30. A computer system as defined in claim 29, wherein the guide exhibits a horizontal aperture.

31. A computer system as defined in claim 25, wherein the slide lock comprises a body portion that is movably positioned within the guide so that the slide lock is movable along a portion of the length of the guide between a first position and a second position.

32. A computer system as defined in claim 31, wherein the slide lock comprises a cam that protrudes from the body of the slide lock in a direction toward the protected switch.

33. A computer system as defined in claim 32, wherein the cam protrudes through the horizontal aperture so that the slide lock is movable along the length of the guide through a distance that is determined by the length of the horizontal aperture.

34. A computer system as defined in claim 33, wherein, when disposed in the first position, the slide lock causes the protected switch to be rendered in a first condition.

35. A computer system as defined in claim 34, wherein, when the slide lock is disposed in the first position, the cam is contiguous to the protected switch.

36. A computer system as defined in claim 33, wherein, when disposed in the second position, the slide lock causes the protected switch to be rendered in a second condition.

37. A computer system as defined in claim 36, wherein, when the slide lock is disposed in the second position, the cam is not contiguous to the protected switch.

38. A computer system as defined in claim 29, wherein the guide exhibits an elongated aperture.

39. A computer system as defined in claim 38, wherein the guide exhibits a horizontal aperture.

40. A computer system as defined in claim 39, wherein the slide lock contains a lock recess configured to be congruent with the enclosure lock recess.

41. A computer system as defined in claim 40, wherein the slide lock comprises a cam that protrudes from the body if the slide lock in a direction toward the protected switch.

42. A computer system as defined in claim 41, wherein the cam protrudes through the horizontal aperture so that the slide lock is movable along the length of the guide through a distance that is determined by the length of the horizontal aperture.

43. A computer system as defined in claim 42, wherein, when disposed in the first position, the slide lock causes the protected switch to be rendered in a first condition.

44. A computer system as defined in claim 43, wherein, when the slide lock is disposed in the first position, the cam is contiguous to the protected switch.

45. A computer system as defined in claim 42, wherein, when disposed in the second position, the slide lock causes the protected switch to be rendered in a second condition.

46. A computer system as defined in claim 45, wherein, when the slide lock is disposed in the second position, the cam is not contiguous to the protected switch.

47. A computer system as defined in claim 44, wherein, when the slide lock is disposed in the first position, the slide lock recess is in alignment with the enclosure lock recess.

48. A computer system as defined in claim 47, wherein the slide lock is disposed in the first position, the switch is OPEN and the computer system function is disabled.

49. A computer system as defined in claim 48, wherein the slide lock is locked in the first position.

50. A computer system as defined in claim 47, wherein the slide lock switch is disposed in the first position, the switch is CLOSED, and the computer system function is enabled.

51. A computer system as defined in claim 50, wherein the slide lock is locked in the first position.

52. A computer system as defined in claim 47, the slide lock is disposed in the first position, the switch is OPEN, and the computer system function is enabled.

53. A computer system as defined in claim 52, wherein the slide lock is locked in the first position.

54. A computer system as defined in claim 47, wherein the slide lock is disposed in the first position, the switch is CLOSED, and the computer system function is disabled.

55. A computer system as defined in claim 54, wherein the slide lock is locked in the first position.

* * * * *